US005615710A

United States Patent [19]

Sato

[11] Patent Number: 5,615,710

[45] Date of Patent: Apr. 1, 1997

[54] PILOT-TYPE CHANGE-OVER VALVE

[75] Inventor: Hideharu Sato, Yawara-mura, Japan

[73] Assignee: SMC Corporation, Tokyo, Japan

[21] Appl. No.: 521,326

[22] Filed: Aug. 30, 1995

[30] Foreign Application Priority Data

Sep. 22, 1994 [JP] Japan ..... 6-254689
Dec. 21, 1994 [JP] Japan ..... 6-335786

[51] Int. Cl.[6] ..... F15B 13/043
[52] U.S. Cl. ..... 137/625.64; 251/29
[58] Field of Search ..... 137/625.64; 251/29

[56] References Cited

U.S. PATENT DOCUMENTS 3,110,468 11/1963 Herion ..... 251/29
3,176,954 4/1965 Cameron et al. ..... 251/29
3,820,567 6/1974 Bouteille ..... 137/625.66
3,969,985 7/1976 Grieger et al. ..... 137/625.64 X
4,646,785 3/1987 Ruedle et al. ..... 137/625.66 X

*Primary Examiner*—Gerald A. Michalsky
*Attorney, Agent, or Firm*—Oblon, Spivak, McClelland, Maier & Neustadt, P.C.

[57] ABSTRACT

A pilot-type change-over valve which includes a main valve segment, a poppet-type amplifying pilot valve that switches the main valve segment by use of a pilot fluid, and a solenoid pilot valve that switches the amplifying pilot valve by use of the pilot fluid. The use of the amplifying pilot valve whose capacity is larger than that of the solenoid pilot valve and corresponds to that of the main valve segment permits switching the large-capacity main valve segment with the small solenoid pilot valve with small power requirement.

1 Claim, 3 Drawing Sheets

PILOT-TYPE CHANGE-OVER VALVE

FIELD OF THE INVENTION

This invention relates to pilot-type change-over valves, and more particularly to pilot-type change-over valves of the type in which a small solenoid valve actuates a larger main valve.

DESCRIPTION OF THE PRIOR ART

Pilot-type change-over valves comprising a main valve segment having multiple ports, communication between the individual ports being switched by a sliding valve member, and a solenoid pilot valve segment that supplies and discharges a pilot fluid to and from a pilot chamber in the main valve segment.

In this known type of pilot-type change-over valve, a the small solenoid pilot valve that does not consume much power actuates the main valve segment with a fast response when the capacity of the main valve segment is small. When the capacity of the main valve segment and that of the pilot chamber into which the pilot fluid to actuate the main valve segment is supplied is increased, the response of the main valve segment lowers significantly because the supply of the pilot fluid made by the small solenoid pilot valve per unit time is insufficient.

This problem can be solved by increasing the supply of the pilot fluid per unit time by increasing the capacity of the solenoid pilot valve. To supply pilot-type change-over valves of various capacities to the market, however, solenoid pilot valves of as many different capacities are required. Manufacturing small quantities of solenoid pilot valves of varied types is very costly. Now that the solenoid pilot valve accounts for a relatively large proportion of the cost of the pilot-type change-over valve, lowering the cost of solenoid pilot valves is essential to the cost reduction of pilot-type change-over valves.

SUMMARY OF THE INVENTION

The object of this invention is to provide pilot-type change-over valves of various capacities at low cost using common interchangeable small solenoid pilot valves of a low-power-consumption type. Any shortage in solenoid pilot valve capacity is made up for by using fluid-driven poppet-type amplifying pilot valves.

To solve the above problem, this invention provides a new type of pilot-type change-over valve comprising a main valve segment having multiple ports to allow the passage of a fluid and a valve member that switches communication between the individual ports and a pilot valve segment that switches the valve member by supplying and discharging a pilot fluid to and from a pilot chamber in the main valve segment. The pilot valve segment of this valve comprises a poppet-type amplifying pilot valve that supplies and discharges the pilot fluid to and from a pilot chamber in the main valve segment and a solenoid pilot valve that switches the amplifying pilot valve by means of the pilot fluid. The amplifying pilot valve has a capacity larger than that of the solenoid pilot valve and corresponding to that of the pilot chamber in the main valve segment.

The amplifying pilot valve according to this invention has a manual operation unit that permits manual supply of the pilot fluid to the pilot chamber of the main valve segment.

In a preferred embodiment of this invention, the solenoid pilot valve is mounted on top of the main valve segment, whereas the amplifying pilot valve is attached to one axial end of the main valve segment, with the manual operation unit placed in a position accessible from above the main valve segment. The solenoid and amplifying pilot valves are directly connected to a supply port in the main valve segment through a pilot supply passage branching off from the supply port.

In another preferred embodiment of this invention, the amplifying pilot valve is attached to one axial end of the main valve segment, with the manual operation unit placed in a position accessible from above the main valve segment, whereas the solenoid pilot valve is attached to the opposite end of the main valve segment. The pilot fluid is supplied from the supply port in the main valve segment to the solenoid pilot valve through the amplifying pilot valve.

When the solenoid of the solenoid pilot valve is energized, the solenoid pilot valve supplies the pilot fluid to the fluid-driven amplifying pilot valve which, in turn, supplies the pilot fluid to the pilot chamber of the main valve segment. Then, the valve member in the main valve segment moves to switch the communication between the multiple ports.

The use of the fluid-pressure-driven poppet-type amplifying pilot valve permits the use of common interchangeable small solenoid pilot valves of a low-power-consumption type. Simple, inexpensive poppet-type amplifying solenoid valves thus making up for the capacity shortage of solenoid pilot valves used in large-capacity change-over valves permit offering pilot-type change-over valves of various capacities at low cost.

This, in turn, permits reducing the size and power requirement of the solenoid pilot valve and the cost of the pilot-type change-over valve as a whole.

Mounting the solenoid pilot valve on top of the main valve segment and attaching the amplifying pilot valve to one axial end of the main valve segment with the manual operation unit placed in a position accessible from above the main valve segment reduces the space requirement of the pilot-type change-over valve having two pilot valve segments and facilitates the operation of the manual operation unit. Because, in addition, the pressurized fluid is directly supplied to the solenoid and amplifying pilot valves through the pilot supply passage branching off from the supply port of the main valve segment, the solenoid and amplifying pilot valves can be replaced and repaired individually.

Mounting the solenoid pilot valve on top of the main valve segment and attaching the amplifying pilot valve to one axial end of the main valve segment with the manual operation unit placed in a position accessible from above the main valve segment permits supplying and discharging the pressurized fluid to and from the solenoid pilot valve through the amplifying pilot valve. This, in turn, simplifies the fluid piping and passage design in the main valve segment. Furthermore, the work required for assembling and disassembling are also simplified now that the solenoid and amplifying pilot valves can be integrally attached to and detached from the main valve segment.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
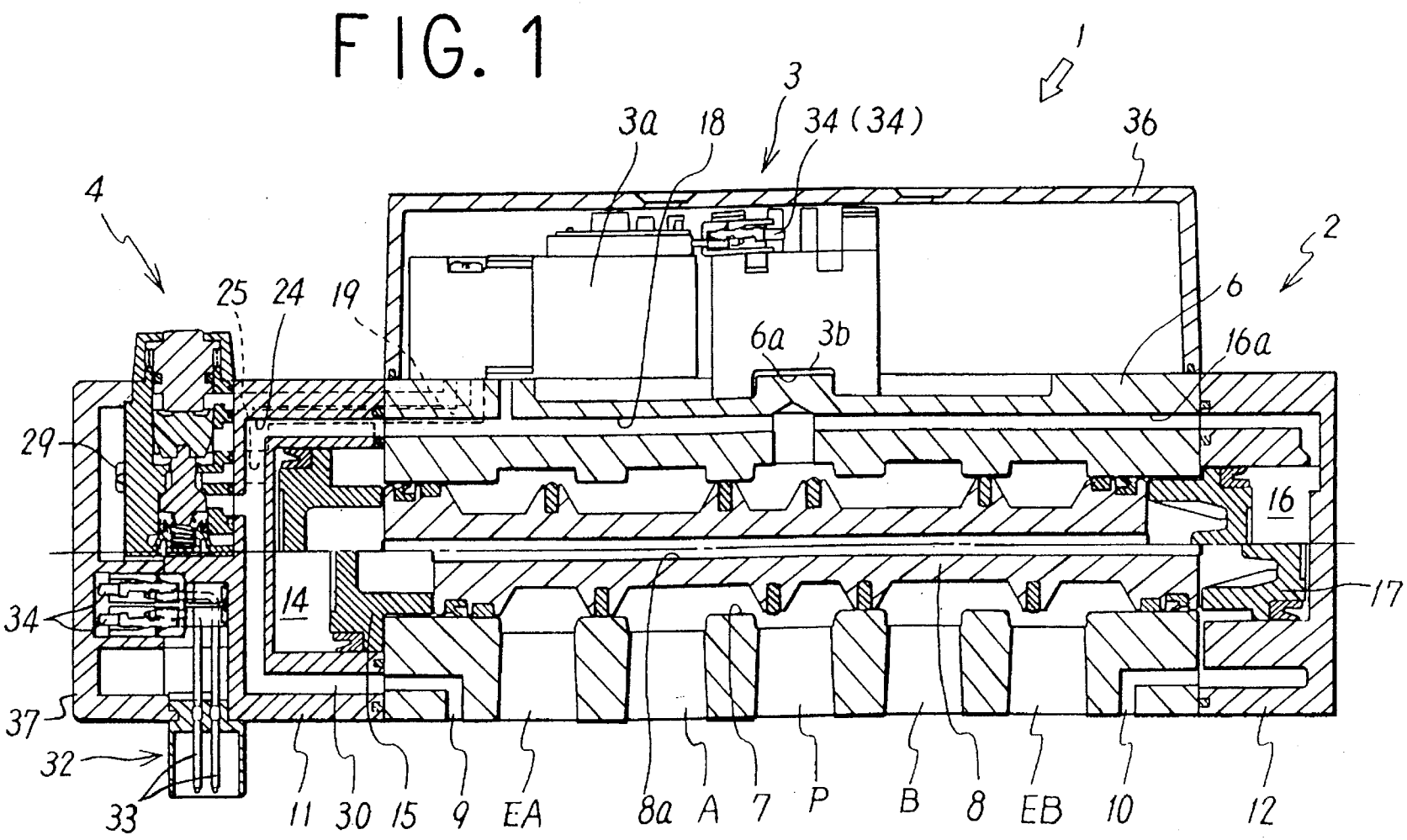
FIG. 1 is a cross-sectional view showing the construction of a first embodiment of this invention, with the upper and lower half parts of the main valve segment showing different switching conditions.
Figure 2:
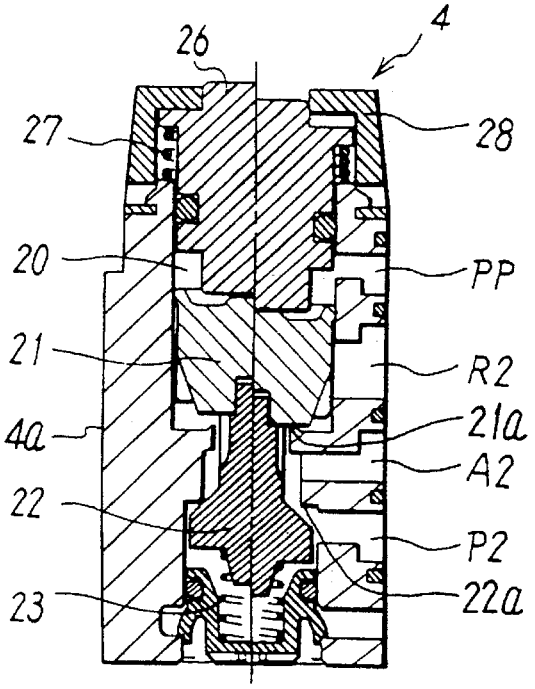
FIG. 2 is a cross-sectional view showing the construction of the amplifying pilot valve, with the right and left half parts showing different switching conditions.
Figure 3:
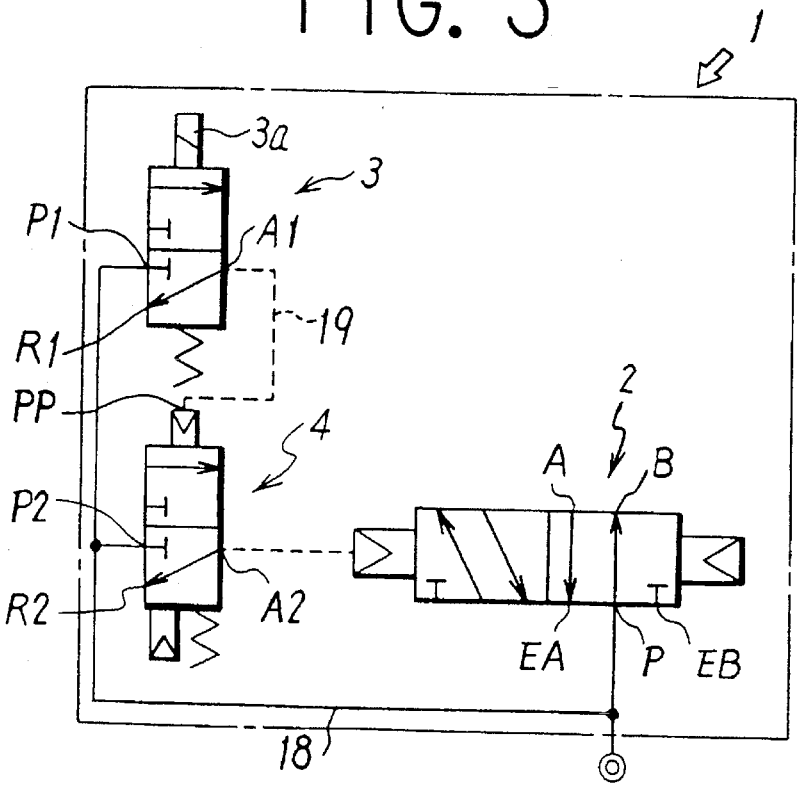
FIG. 3 is a block diagram showing the construction of the first embodiment of this invention.

FIGS. 1 to 3 show a first embodiment of this invention. A pilot-type change-over valve 1 comprises a large-capacity spool-type main valve segment 2 with a high fluid throughput in unit time and a pilot valve segment that supplies and discharges a pilot fluid to and from a pilot chamber in the main valve segment 2. The pilot valve segment comprises a solenoid pilot valve 3 and a hydraulically driven amplifying pilot valve 4 that increases the output of the solenoid pilot valve 3, which are mounted on a manifold base not shown.

The valve body 6 of the main valve segment 2 has a compressed air supply port P, output ports A and B, and exhaust ports EA and EB in the surface that faces the manifold base and a valve port 7 into which said ports open in the center of the valve body 6. In the valve port 7 is slidably fitted a spool-type valve member 8 that switches the communication of the output ports A and B with the supply port P and the exhaust ports EA and EB, thus forming a change-over valve of know type. An external pilot port 9 and a respiration port 10 are also provided in the surface that faces the manifold base.

The pilot-type change-over valve 1 and the manifold base are so designed that the ports in the bottom of the valve body 6 communicate with the mating ports in the manifold base when the valve body 6 of the main valve segment 2 is mounted on the manifold base.

A first piston box 11 and a second piston box 12 are attached to both axial ends of the valve body 6. In the first piston box 11, a pilot chamber 14 is provided so that the opening thereof leads to one end surface of the valve member 8. A first piston 15 is slidably fitted in the pilot chamber 14. The second piston box 12 has a return pressure chamber 16 having a smaller cross-sectional area than the pilot chamber 14 is provided so that the opening leads to the other end surface of the valve member 8. A second piston 17 having a smaller diameter than the first piston 15 is slidably fitted in the return pressure chamber 16. The valve member 8 is disposed so as to be moved back and forth by the two pistons.

An axial through hole 8*a* formed in the valve member 8 establishes communication between the valve member 8 and the individual respiration chambers between the pistons 15 and 17. The return pressure chamber 16 partitioned off by the second piston 17 is in communication with the supply port P through a passage 16*a*.

The solenoid pilot valve 3 constitutes a small-sized, small-capacity solenoid-driven pilot valve segment of low-power-consumption type. The capacity of the solenoid pilot valve 3 corresponds to the small capacity of the main valve segment that can be driven, with fast response, by the solenoid pilot valve alone.

As shown in FIG. 3, the solenoid pilot valve 3 is a three-port valve of known type that has a first pilot supply port P1, a first pilot output port A1 and a first pilot exhaust port R1. Energization and release of a solenoid 3*a* switches the communication of the first pilot output port A1 with the first pilot supply port P1 and the first pilot exhaust port R1.

The first pilot supply port P1 communicates with the supply port P in the main valve segment through a first pilot supply passage 18 formed in the valve body 6. The first pilot output port A1 communicates with a pilot port PP (FIG. 2) in the amplifying pilot valve 4 through a first pilot output passage 19 formed in the valve body 6 and the first piston box 11. The first pilot exhaust port R1 communicates with the respiration chamber between the first piston 15 and the valve member 8 through a passage not shown and leads to outside through the through hole 8*a* and respiration port 10.

The solenoid pilot valve 3 also has a recess 3*b* adapted to mate with a positioning projection 6*a* formed on the top surface of the valve body 6. The solenoid pilot valve 3 is placed in position by the engagement of the positioning projection 6*a* with the recess 3*b* and fastened to the top surface of the valve body 6 by suitable means.

FIG. 2 shows details of the amplifying pilot valve 4 whose valve body 4*a* has a second pilot supply port P2, a second pilot output port A2, a second pilot exhaust port R2 and a pilot port PP, with valve seats 21*a* and 22*a* set in opposite directions on both sides of the second pilot supply port P2. At one end of the valve body 4*a* is provided a pilot chamber 20 into which the pilot port PP opens. A pilot piston 21 is hermetically and slidably fitted in that side of the pilot chamber 20 where the second pilot exhaust port R2 opens. The pilot piston 21 disposed opposite the valve seat 21*a* functions as a poppet valve member that opens and closes the valve seat. A poppet-type pilot valve member 22 that opens and closes the valve seat 22*a* when moved back and forth by the pressure of the pilot piston 21 is provided in a valve chamber that brings the second pilot supply port P2 and the second pilot output port A2 into communication with each other. The poppet-type pilot valve member 22 is urged in the closing direction by a return spring 23.

The pilot piston 21 is cut short to reduce resistance to a stream of pressurized air flowing from the valve seat 21*a* to the second pilot exhaust port R2, whereas a portion of the pilot valve member 22 coming in contact with the valve seat 22*a* is conically shaped to reduce resistance to a stream of pressurized air flowing from the second pilot supply port P2 to the second pilot output port A2.

The pilot piston 21 and pilot valve member 22 are made of material having both elasticity and sealing properties.

A manual operation member 26 that closes the top end of the pilot chamber 20 can be manually depressed from outside against the force of the return spring 27. A cap 28 mounted on the body 4*a* of the pilot valve segment keeps the manual operation member 26 from jutting out. The manual operation member 26, which depresses the pilot piston 21 when manually depressed, forms a manual operation unit to switch the amplifying pilot valve 4.

The amplifying pilot valve 4 is fastened to a side of the first piston box 11 or an axial end of the main valve segment with a bolt 29, with the manual operation member 26 placed in a position accessible from above for ease of operation.

When no pilot air is supplied to the pilot chamber 20, the pilot valve member 22 in the amplifying pilot valve 4 closes the valve seat 22*a* by the force of the return spring 23 working thereon while opening the valve seat 21*a* by pressing the pilot piston 21. When the pilot air from the solenoid pilot valve 3 is supplied into the pilot chamber 20 through the pilot port PP, the pilot piston 21 and pilot valve member 22 are pressed against the force of the return spring 23, whereupon the pilot piston 21 closes the valve seat 21*a* and the pilot valve member 22 opens the valve seat 22*a*. Thus, the amplifying pilot valve 4 functions as a pneumatically operated poppet-type three-port valve of known type that switches the communication of the second pilot output port A2 with the second pilot supply port P2 and the second pilot exhaust port R2.

As will be evident from FIGS. 1 and 3, the second pilot supply port P2 communicates with the supply port P in the main valve segment 2 through a second pilot supply passage 24 communicating with the first pilot supply passage 18, the second pilot output port A2 communicates with the pilot chamber 14 in the main valve segment 2 through a second pilot output passage 25, and the second pilot exhaust port R2 communicates with a respiration chamber between the first piston 15 and valve member 8 through a passage not shown.

The amplifying pilot valve 4 has a capacity appropriate for the pilot chamber 14 of the large-capacity main valve segment 2 so that a large quantity of pilot air can be supplied to the pilot chamber 14 in a short time. The amplifying pilot 4 operated by the pilot air supplied from and discharged to the solenoid pilot valve 3 and amplifying the supply of pilot air to the pilot chamber 14 is cheaper than the solenoid pilot valve 3. The use of amplifying pilot valves whose capacity corresponds to the capacity of the individual pilot chambers 14 reduces the manufacturing cost of pilot-type change-over valves, as compared with the use of solenoid pilot valves 3 whose capacity is proportional to the capacity of the main valve segment 2.

The external pilot port 9 in the valve body 6 communicates with the second pilot supply passage 24 through an external pilot passage 30. Therefore, this pilot-type change-over valve can serve as either an internal pilot valve or an external pilot valve, as required.

When serving as an internal pilot valve that introduces a pilot fluid from the supply port P of the main valve segment 2, the external pilot port 9 is closed by a ball or other suitable means not shown. When serving as an external pilot valve introducing a pilot fluid from outside through the external pilot port 9, the supply port P in the main valve segment 2 is cut off from the first pilot supply passage 18 and the passage 16*a* by suitable means not shown.

A power supply unit 32 to supply electricity to the solenoid 3*a* of the solenoid pilot valve 3 is provided below the amplifying pilot valve 4.

The power supply unit 32 has a pair of power-receiving terminals 33 projecting downward from the bottom of the valve body 6. A conductor 34 electrically connected to the power-receiving terminals 33 is electrically connected to the terminal of the solenoid 3*a* of the solenoid pilot valve 3 through a passage (not shown) provided in the first piston box 11 and valve body 6. The power-receiving terminals 33 are designed to establish an electrical connection with the power-supplying terminals on the manifold base when the main valve segment 2 is mounted thereon. When the pilot-type change-over valve i is mounted on the manifold base, accordingly, power is supplied from the power-supplying terminals on the manifold base to the solenoid 3*a* of the solenoid pilot valve 3.

Reference numerals 36 and 37 designate covers placed over the solenoid pilot valve 3 and the power supply unit 32, respectively, which are made of transparent or translucent material.

When the solenoid 3*a* of the solenoid pilot valve 3 in the first embodiment described above is not energized, no pressurized air is supplied to the pilot chamber 20 in the amplifying pilot valve 41. The pilot air in the pilot chamber 14 is discharged outside through the second pilot output port A2 and the second pilot exhaust port R2 in the amplifying pilot valve 4. With the valve member 8 of the main valve segment 2 moved to the left in FIG. 1 by the action of the air pressure in the return pressure chamber 16, therefore, the supply port P is in communication with the output port B, and the output port A is in communication with the exhaust port EA (see the upper half of the valve member in FIG. 1).

When the solenoid 3*a* of the solenoid pilot valve 3 is energized by the power supplied from the power supply unit 32, the first pilot output port A1 communicates with the first pilot supply port P1, whereupon the pilot air is supplied to the pilot chamber 20 in the amplifying pilot valve 4, as shown in FIG. 3. Then, the second pilot output port A2 communicates with the second pilot supply port P2 to supply the pilot air to the pilot chamber 14 in the main valve segment 2. Because of the difference between the pressure-receiving areas of the pilot chamber 14 and the return pressure chamber 16, the first piston 15 moves to the right in FIG. 1, thereby pressing the valve member 8 and bringing the supply port P and output port A, and the output B and exhaust port EB, into communication with each other (see the lower half of the valve member 8 in FIG. 1).

When the solenoid 3*a* is de-energized, the first pilot outlet port A1 of the solenoid pilot valve 3 comes into communication with the first exhaust port R1 to discharge the air in the pilot chamber 20 of the amplifying pilot valve 4 to the outside. Then, the return spring 23 brings the pilot valve member 22 back to its original position, thus bringing the second pilot output port A2 into communication with the second pilot exhaust port R2. This expels the pilot air in the pilot chamber 14 to the outside, whereby the air pressure in the return pressure chamber 16 that works on the second piston 17 brings the valve member 8 back to its original position.

The valve member 8 of the main valve segment 2 that switches the communication between the individual ports is actuated by a large quantity of pilot air corresponding to the capacity of the pilot chamber 14 that is supplied thereto from the poppet-type amplifying pilot valve 4. Because the amplifying pilot valve 4 is of the poppet type permitting a high rate of flow, even the small solenoid pilot valve 3 consuming less power can move the main valve segment 2 with fast response. Thus, pilot-type change-over valves providing fast response are available at low cost.

The manual operation member 26 provided in the amplifying pilot valve 4 so as to be accessible from above the main valve segment 2 permits manual operation of the main valve segment 2 when operation by the solenoid pilot valve 2 becomes impossible due to power failure, machine breakdown or other troubles. The manual operation member 26 is located in an easy-to-operate position.

Figure 4:
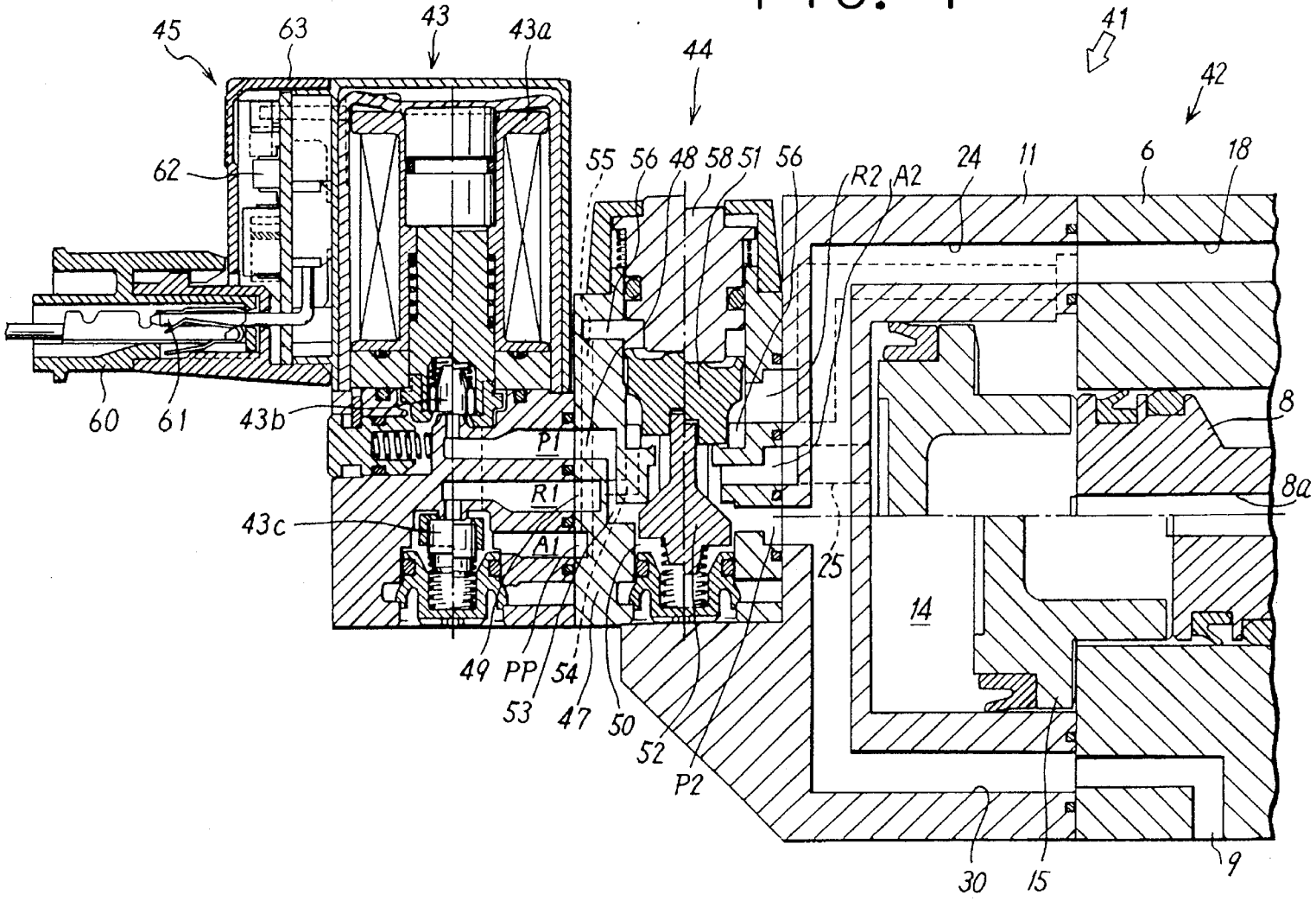
FIG. 4 is a cross-sectional view showing the principal construction of a second embodiment of this invention, with the upper and lower half parts of the main valve segment and the right and left half parts of the solenoid and amplifying pilot valves showing different switching conditions.

FIG. 4 shows the principal parts of a second embodiment of this invention. A pilot-type change-over valve 41 comprises a main valve segment 42, a solenoid pilot valve 43, a fluid-driven amplifying pilot valve 44 and a power supply unit 45 that supplies electricity to a solenoid 43*a* in the solenoid pilot valve 43, which are attached, one next to the other, to one axial end of a valve member 8 in the main valve segment 42.

The main valve segment 42 is substantially similar to the main valve segment 2 of the first embodiment, with the exception of the construction of the solenoid pilot valve 43 and that of the passages by means of which connection with the solenoid pilot valve 43 is achieved. Therefore, similar parts are designated by similar reference characters, with description thereof omitted.

The solenoid pilot valve 43 constitutes a small-sized, small-capacity solenoid pilot valve segment with small power requirement, like the solenoid pilot valve 3 of the first embodiment. Like the one shown in FIG. 3, the solenoid pilot valve 43 too has a first pilot supply port P1, a first pilot output port A1 and a first pilot exhaust port R1. Energization and de-energization of the solenoid 43*a* alternately open and close pilot valve members 43*b* and 43*c*. When the pilot valve member 43*b* opens, the first pilot supply port P1 comes into communication with the first pilot output port A1 through a passage not shown. When the pilot valve member 43*c* opens, the first pilot output port A1 comes into communication with the first pilot exhaust port R1. Thus, the solenoid pilot valve 43 is a three-port solenoid valve of known type.

Like the amplifying pilot valve 4 of the first embodiment (shown in FIG. 2), the amplifying pilot valve 44 also has the capacity to supply a large quantity of pilot air to the pilot chamber 14 in the large-capacity main valve segment in a short time.

The valve body 47 of the amplifying pilot valve 44 has a second pilot supply port P2, a second pilot output port A2 and a second pilot exhaust port R2 that open in the surface facing the first piston box 11 of the main valve segment 42 and a compressed air supply port 48, a compressed air discharge port 49 and a pilot port PP that open in the opposite surface, and valve port 50 extending axially therethrough. A pilot piston 51 and a pilot valve member 52 inserted in the valve port 50 are joined together so that they can move integrally.

A pilot chamber 56 is formed outside the pilot piston 51. The valve body 47 of the amplifying pilot valve 44 slidably holds a manual operation member 58 that can be manually depressed from outside against the force of a return spring 59 and closes the upper end of the pilot chamber 56. The manual operation member 58 that is disposed to depress the pilot piston 51 when manually depressed forms a manual operation unit to switch the amplifying pilot valve 44.

The supply port 48 in the valve body 47 communicates with the second pilot supply port P2 through a supply passage 53 and a space around the pilot valve member 52 in the valve port 50, the exhaust port 49 communicates with the second pilot exhaust port R2 through an exhaust passage 54 and a space around the pilot piston 51 in the valve port 50, and the pilot port PP communicates with the pilot chamber 56 outside the pilot piston 51 through a pilot passage 55.

A guide projection 57 provided inside the valve port 50 on the valve seat side of the pilot piston 51 guides the slide of the pilot piston 51. The guide projection 57 is integral with the valve body 47.

Like their counterparts in the first embodiment, the pilot piston 51 and pilot valve member 52 are made of material having both elasticity and sealing properties and opens and closes the fluid passage by coming in and out of contact with a valve seat provided in a position similar to the one in the first embodiment.

A detailed description of other structural features and functions of the amplifying pilot valve 44 is omitted as they are substantially similar to those of the amplifying pilot valve 4 of the first embodiment.

The solenoid pilot valve 43 is attached to that side of the amplifying pilot valve 44 which is opposite to the side to which the main valve segment is connected. When the solenoid and amplifying pilot valves 43 and 44 are joined together, the first pilot supply port P1 comes into communication with the supply port 48, the first pilot output port A1 with the pilot port PP of the amplifying pilot valve 44, and the first pilot exhaust port R1 with the exhaust port 49.

The power supply unit 45 that supplies electricity to the solenoid 43*a* of the solenoid pilot valve 43 comprises a power receiving terminal 61 to which an external power supply socket 60 is fitted and a conductor that passes electricity from the power receiving terminal 61 to the solenoid 43*a* through an electronic part 62 which are contained in a cover 63.

With the amplifying and solenoid pilot valves 44 and 43 attached to one side of the main valve segment 42, the pilot-type change-over valve 41 is low profiled. Compressed air is supplied from the supply port 48 of the amplifying pilot valve 44 to the first pilot supply port P1 and discharged from the exhaust port 49 thereof to the exhaust port R1. This simplifies the fluid piping and passage design in the main valve segment. Furthermore, the work is assembling and disassembling are also simplified now that the solenoid and amplifying pilot valves 43 and 44 can be integrally attached to and detached from the main valve segment.

Although the main valve segments 2 and 42 in the embodiments described here are of the five-port type, main valve segments of this invention are by no means limited thereto. Four- or three-port valves can serve the purpose of this invention, as well. The valve member 8 may also be returned to its original position by the force of a return spring provided in the return pressure chamber 16 or by the combined force of pneumatic pressure and the return spring.

The pilot-type change-over valves of this invention described above permit using common interchangeable small solenoid pilot valves with small power requirements. Fluid-pressure-driven poppet-type amplifying pilot valves make up for any capacity shortage due to the use of such small solenoid pilot valves in large-capacity change-over valves. Thus, this invention permits supplying pilot-type change-over valves of various capacities at low cost. Despite the use of small solenoid pilot valves, the large-capacity main valve segment can be actuated with fast response.

Mounting the solenoid pilot valve on top of the main valve segment and the amplifying pilot valve to one axial end thereof, with the manual operation unit placed in a position accessible from above the main valve segment, permits installing a pilot-type change-over valve having two pilot valve segments in a small space while facilitating the manual operation of the amplifying pilot valve. Because, in addition, the pressurized fluid is directly supplied to the solenoid and amplifying pilot valves through the pilot supply passage branching off from the supply port of the main valve segment, the solenoid and amplifying pilot valves can be replaced and repaired individually.

Attaching both the amplifying and solenoid pilot valves, one next to the other, to one axial end of the main valve segment permits supplying and discharging the pressurized fluid to and from the solenoid pilot valve through the amplifying pilot valve. This simplifies the fluid piping and passage design in the main valve segment. Furthermore, the work needed in assembling and disassembling is also simplified now that the solenoid and amplifying pilot valves can be integrally attached to and detached from the main valve segment.

What is claimed is:

1. A pilot-type change-over valve, comprising:

a main valve segment having multiple ports passing a fluid, a valve member switching communication between the individual ports and a pilot valve segment switching the valve member by supplying and discharging a pilot fluid to and from a pilot chamber in the main valve segment, the pilot valve segment comprising a poppet-type amplifying pilot valve supplying and discharging the pilot fluid to the pilot chamber in the main valve segment and a solenoid pilot valve switching the amplifying pilot valve by utilizing the pilot fluid; and the amplifying pilot valve having a capacity larger than the capacity of the solenoid valve and corresponding to the capacity of the pilot chamber in the main valve segment, wherein the amplifying pilot valve comprises a manual operation unit permitting a supply of the pilot fluid to the pilot chamber in the main valve segment by manual operation, the amplifying pilot valve being located so as to minimize the length of a passage communicating the amplifying pilot valve with the pilot chamber and to increase response speed;

the solenoid pilot valve is mounted on top of the main valve segment and the amplifying pilot valve is attached to one axial end of the main valve segment and is separated from said solenoid pilot valve, with the manual operation unit being located in a position accessible from above the main valve segment and the manual operating member switching the valve member in the absence of operation of the solenoid valve member, and wherein the solenoid and amplifying pilot valves are directly connected to a supply port of the main valve segment through a pilot supply passage branching off from the supply port.

* * * * *